US006544089B2

(12) United States Patent
Zapatero Denegri

(10) Patent No.: US 6,544,089 B2
(45) Date of Patent: Apr. 8, 2003

(54) TWO-HAND BODYSURFING AND SWIMMING AID

(76) Inventor: Hector Felix Armando Zapatero Denegri, Via Fra Cristoforo, 14/b, Milano, MI (IT), 20142

( * ) Notice: Subject to any disclaimer, the term of this patent is extended or adjusted under 35 U.S.C. 154(b) by 0 days.

(21) Appl. No.: 09/738,504

(22) Filed: Dec. 18, 2000

(65) Prior Publication Data

US 2001/0029136 A1 Oct. 11, 2001

(30) Foreign Application Priority Data

Apr. 11, 2000 (IT) ..... MI00A0790
Jul. 21, 2000 (EP) ..... 00202631

(51) Int. Cl.[7] ..... B63B 1/00
(52) U.S. Cl. ..... 441/65
(58) Field of Search ..... 441/56, 65, 74, 441/75

(56) References Cited

U.S. PATENT DOCUMENTS 4,439,165 A * 3/1984 Rothstein ..... 441/74
4,619,619 A * 10/1986 Muse, Jr. ..... 441/75
5,472,362 A * 12/1995 Dandurand ..... 441/65

* cited by examiner

*Primary Examiner*—Jesus D. Sotelo

(57) ABSTRACT

A device for use in the sport of Bodysurfing and as a general swimming aid, adapted to be held and guided with the two hands placed one beside the other in the horizontal level; the device comprising a FLOATING BODY which has the general shape of a surfboard or windsurf, in miniature and with different proportions, said FLOATING BODY further comprising the following three other elements: a SYSTEM OF DIRECTIONAL FINS (two lateral forward fins plus one central rear fin) placed in the tail area of its bottom surface; a GADGET FOR THE TYING OF A SECURITY CORD placed in the tail area of its top surface; and a HANDLING SYSTEM composed of a single over-raised tubular handle which runs across its top surface from side to side.

5 Claims, 7 Drawing Sheets

Back view

TWO-HAND BODYSURFING AND SWIMMING AID

REFERENCE TO A MICROFICHE APPENDIX

Not Applicable

BACKGROUND OF THE INVENTION

The present invention concerns a device for use in the practice of the sport called Bodysurfing, and as a general swimming aid.

The sport of bodysurfing consists in riding (surfing) the ocean waves with the own body. To practice this sport the bodysurfer swims strongly with the passing wave in order to "catch" it, after which he raises his head above the water level and rides the wave with his body, selectedly leaving his arms behind or extending one or both arms in front of him, generally merely touching or slightly leaning one hand over the water's surface.

The main difficulty bodysurfers find is that of being left behind by the waves because of insufficient speed; a problem caused by the fact that almost the whole body of the bodysurfer (except for the head and eventually the arms) travels under the water's surface, offering too much drag. The prior art has proposed some devices intended to assist the bodysurfer in riding the waves, by offering him an alternative leaning point for the hand over the surface of the water. However this bodysurfing devices—mainly "Handboards" and "Hand fins"—have not proven to be sufficiently effective in terms of overall performance, security of use and visual attractivity, for the following reasons:

1. They are held and guided with only one hand.

(U.S. Pat. No. 4,437,842 "Surfing Device" offers the possibility of placing the free hand directly over a top covering the hand that holds and guides the device; U.S. Pat. No. 5,167,551 "Bodysurfing and swimming aid" and U.S. Pat. No. 4,932,911 "Handboards" suggest the use of two separate devices, one for each hand).

The single pressure-control point thus determined limits the device's steerability because the hand (or hands) concentrate in one single point, and does not provide sufficient speed because there's a limit to the maximum width of the hydroplaning surface under such single pressure-control point. In case of using two separate devices (U.S. Pat. No. 5,167,551 and U.S. Pat. No. 4,932,911) it must be observed that when maneuvers are made it is only the device of the hand corresponding to the side towards which one is turning that actually works. Also, it is practically impossible to maintain two separate devices always completely aligned when riding a wave.

2. They are secured to the hand that holds them.

(In the case of U.S. Pat. No. 4,932,911 "Handboards" by means of straps; in the cases of U.S. Pat. No. 5,167,551 "Bodysurfing and swimming aid" and U.S. Pat. No. 4,437,842 "Surfing Device" the hand enters inside a compartment that is part of the device itself).

The fact of having the hand confined inside a compartment or however secured to the device can cause wrist torsions in case of sudden violent movements (for example when being caught by the wave after missing a maneuver, or when the wave suddenly closes out); in such cases it may be difficult or even impossible to liberate the hand from the device. Having the device somehow fixed to the hand also difficults the free-style swimming necessary to get in position among the waves.

3. They have peculiar, sui generis, shapes.

(U.S. Pat. No. 4,437,842 "Surfing Device": "general teardrop shape"; U.S. Pat. No. 4,932,911 "Handboards": "extremely rounded isosceles triangle"; U.S. Pat. No. 5,167,551 "Bodysurfing and swimming aid": "Hand fin of streamlined shape ( . . . ) with a longer outer rail and a shorter inner rail".

Thus these objects appear somewhat esthetically strange, and are difficult to recognize for the general public.

Even if bodysurfing may not be an easy sport to practice (one needs to be a good swimmer and know the ocean), it is considered that the inefficiencies presented by the devices of the prior art can explain—at least partially—why the sport of bodysurfing has not developed as much as its closest related sports, surfing and bodyboarding.

BRIEF SUMMARY OF THE INVENTION

The present invention is the result of its author's twenty-year international experience in the design and construction of devices for wave riding sports (bodysurfing, bodyboarding, kneeboarding, surfing and windsurfing (wave)).

The main object of the present invention is to contribute to the development of the sport of Bodysurfing, by providing a device that offers optimal efficiency in terms of overall performance, safety of use and visual attractivity, for users of both sexes. It is another object of the present invention to provide a device that can be used as an efficient swimming aid.

The present invention, which is called TWO-HAND BODYSURFING AND SWIMMING AID, comprises a floating body which further comprises the following three other elements: a handling system on its top surface, which permits to hold and guide the device with the two hands placed one beside the other in the horizontal level; a system of directional fins on the tail area of its bottom surface; and a gadget intended for the tying of a security cord placed (preferably but not exclusively) in the tail area of its top surface.

The optimal efficiency of the present invention in terms of overall performance derives from the fact that during bodysurfing it is guided and controlled with the two hands placed one beside the other in the horizontal level. This causes the upper half of the body to travel in a position equivalent to an elongated gymnastical push-up performed over the invention's handling system, above the water's surface more or less from the waist up (depending on the actual trajectory). A "wave-riding binomial" is formed by the invention and the user's body, in which the invention rides the wave supported by the weight of the upper half of the user's body, and complemented by the lower half of the user's body, which remains inside the water giving the necessary extra drag and steering capability. The natural advantages of this system are greater speed (because there is a big enough hydroplaning surface under the hands and a smaller portion of the body that travels inside the water, giving less resistance) as well as total control and steerability (because the invention is firmly held and controlled with the two hands placed horizontally one beside the other, grabbing the aforementioned handling system).

The optimal security of use of the invention is due to the fact that the hands are not confined in it or fixed to it in any way, but are independent from it. There is no risk of wrist torsions during critical moments (for example when missing a maneuver or when the wave closes out), because the invention is firmly held with the two hands, and consequently it can be easily kept with or pushed aside. In this last case (when the invention has been pushed aside) once the wave has gone it can be easily reached by pulling the security cord which ties it to the user's waist (the system of a security cord is also used in surfboards and bodyboards).

The optimal visual attractivity of the invention is due to the fact that its floating body resembles a surfboard or windsurf in miniature, even if proportionally wider and with a different thickness distribution. In such way the invention profits from the "good looks" of those boards, being easily identifiable by the public as an object made for riding waves.

The user enters the ocean with the invention secured to his waist by means of the aforementioned "security cord", which prevents him from losing the invention in the surf.

There are three ways or styles in which to swim with the invention; the user may choose one depending on his level of expertise, and on his actual physical state (more or less tired). These are the following:

1. The invention is held in front of the body with both hands; thus the upper part of the body leans over the invention, and the swimmer paddles only with his legs.
2. The invention is held in front of the body with only one hand; the swimmer paddles with his legs and one arm.
3. The swimmer swims in a normal free-style, using both arms and both legs to paddle, literally towing the invention—which is secured to his waist by the security cord—behind his body.

Once in position, to catch a wave the user must swim strongly with the two legs and one arm, meanwhile holding the invention and keeping it pointed forward with the other arm and hand. As soon as he catches the wave the user must raise his head and quickly take the free arm and hand forward in order to grab the invention's handling system also with that hand.

The wave is ridden by holding and guiding the device with both hands placed one beside the other in the horizontal level, grabbing the invention's handle.

BRIEF DESCRIPTION OF THE SEVERAL VIEWS OF THE DRAWINGS

In the following section an example of embodiment of the present invention will be described in detail, referring to the appended drawings, in which.

DETAILED DESCRIPTION OF THE INVENTION

The prototype model of the present invention here described measures 45,5×29,5 centimeters; it is considered that the invention should not exceed 55 centimeters in longitude, because of the risk that it could touch against the user's chest.

Figure 1:
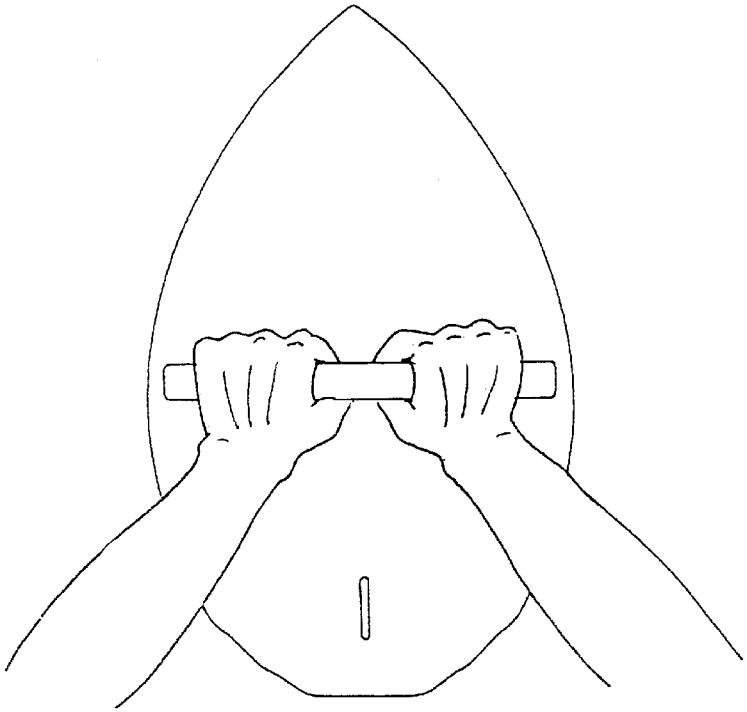
FIG. 1 shows the way the present invention is held during use.
Figure 2:
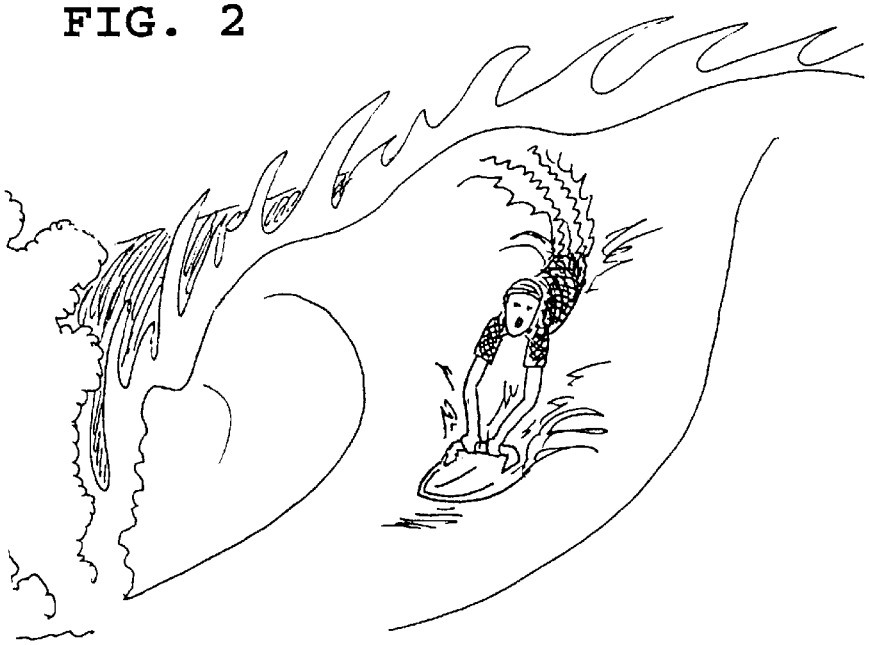
FIG. 2 shows how a wave is ridden with the use of the present invention.

As can be seen in FIG. 1 and FIG. 2 the use of a device which is held and guided with both hands placed one beside the other in the horizontal level constitutes a new way of practicing bodysurfing, characterized in that the upper part of the body (more or less from the waist up, depending on the actual trajectory) travels above the water's surface, suspended on the air by the two arms that perform the equivalent of an elongated gymnastical push-up (with the hands closer and extended forward) over the invention's handling system.

Figure 3:
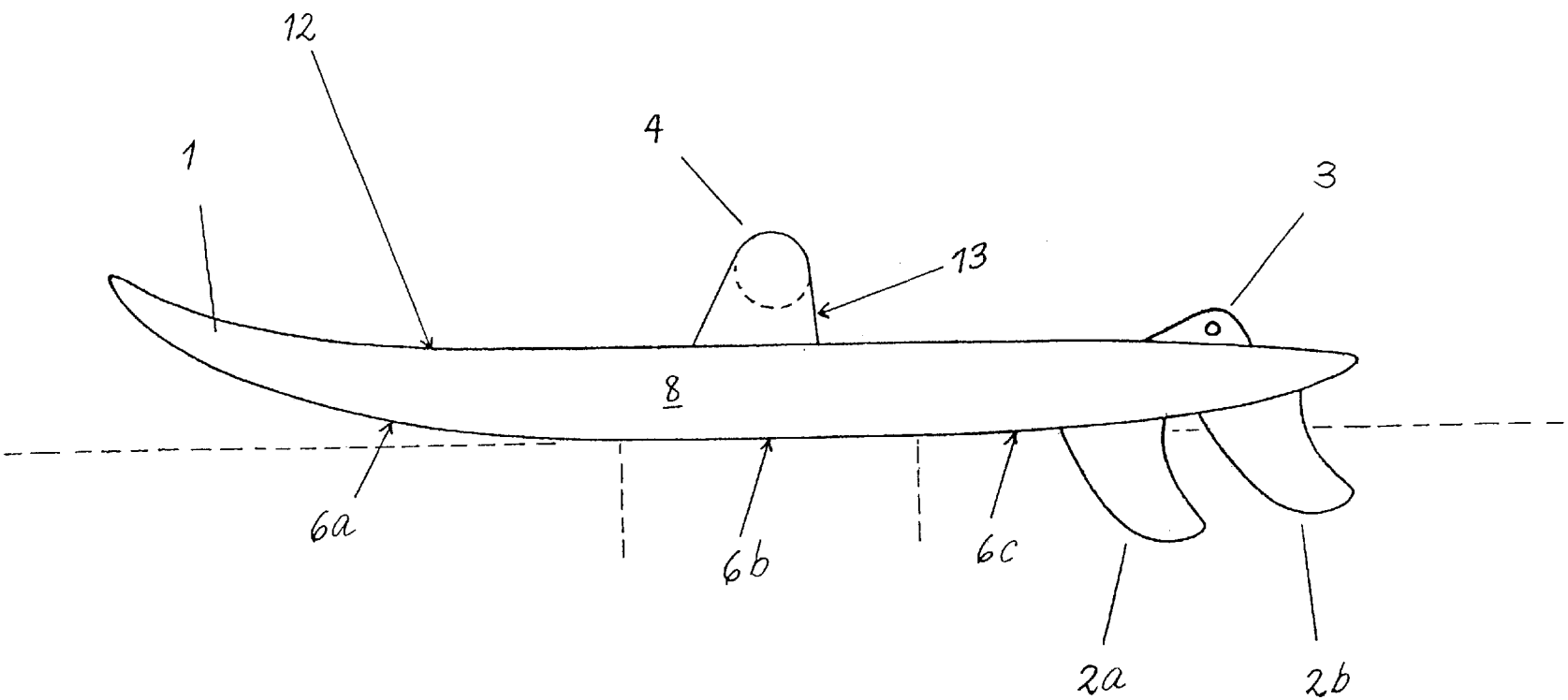
FIG. 3 is a lateral plan view of the present invention.
Figure 4:
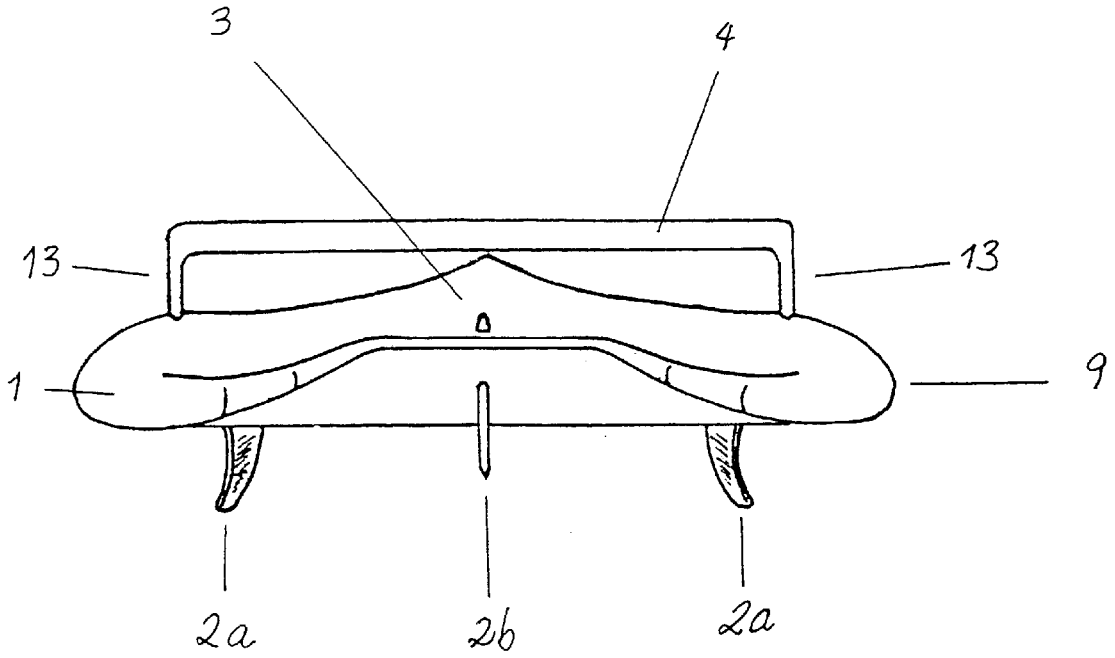
FIG. 4 is a back view of the present invention.

As shown in FIG. 3 and FIG. 4 the prototype model comprises a FLOATING BODY 1 which in its bottom surface includes a SYSTEM OF DIRECTIONAL FINS composed of three small fins (two lateral forward fins 2*a* plus one central rearward fin 2*b*), and in its top surface includes a GADGET FOR THE TYING OF A SECURITY CORD 3 and a HANDLING SYSTEM composed of a single tubular over-raised handle 4 that runs transversally across the width of the device.

Referring to FIG. 3, FIG. 4, FIG. 5 and FIG. 6 the FLOATING BODY 1 has the general shape of a surfboard or windsurf in miniature, proportionally wider and with a different thickness distribution (in particular the area above the forward fins is proportionally thicker than in surfboards or windsurfs; this is done to give enough buoyancy in view of the fact that the invention supports the whole weight of the upper half of the user's body). The FLOATING BODY 1 comprises the following four dimensions, which determine and condition its functioning: The outer planshape 5, the floatation line 6*a*, 6*b*, 6*c*/hydroplaning surface 7, the overall thickness 8 and the lateral edges' profile 9.

Figure 5:
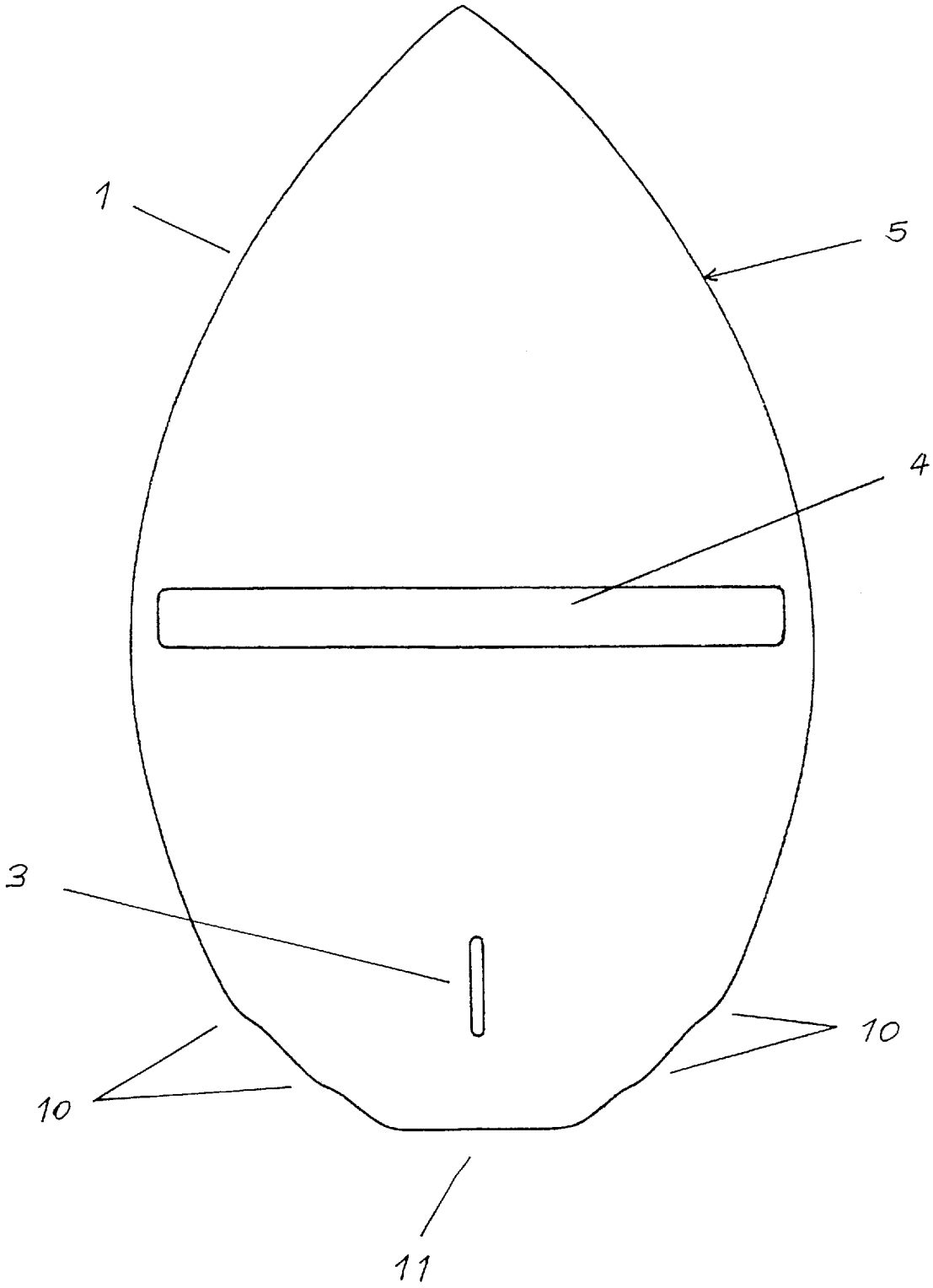
FIG. 5 is a top plan view of the present invention.
Figure 6:
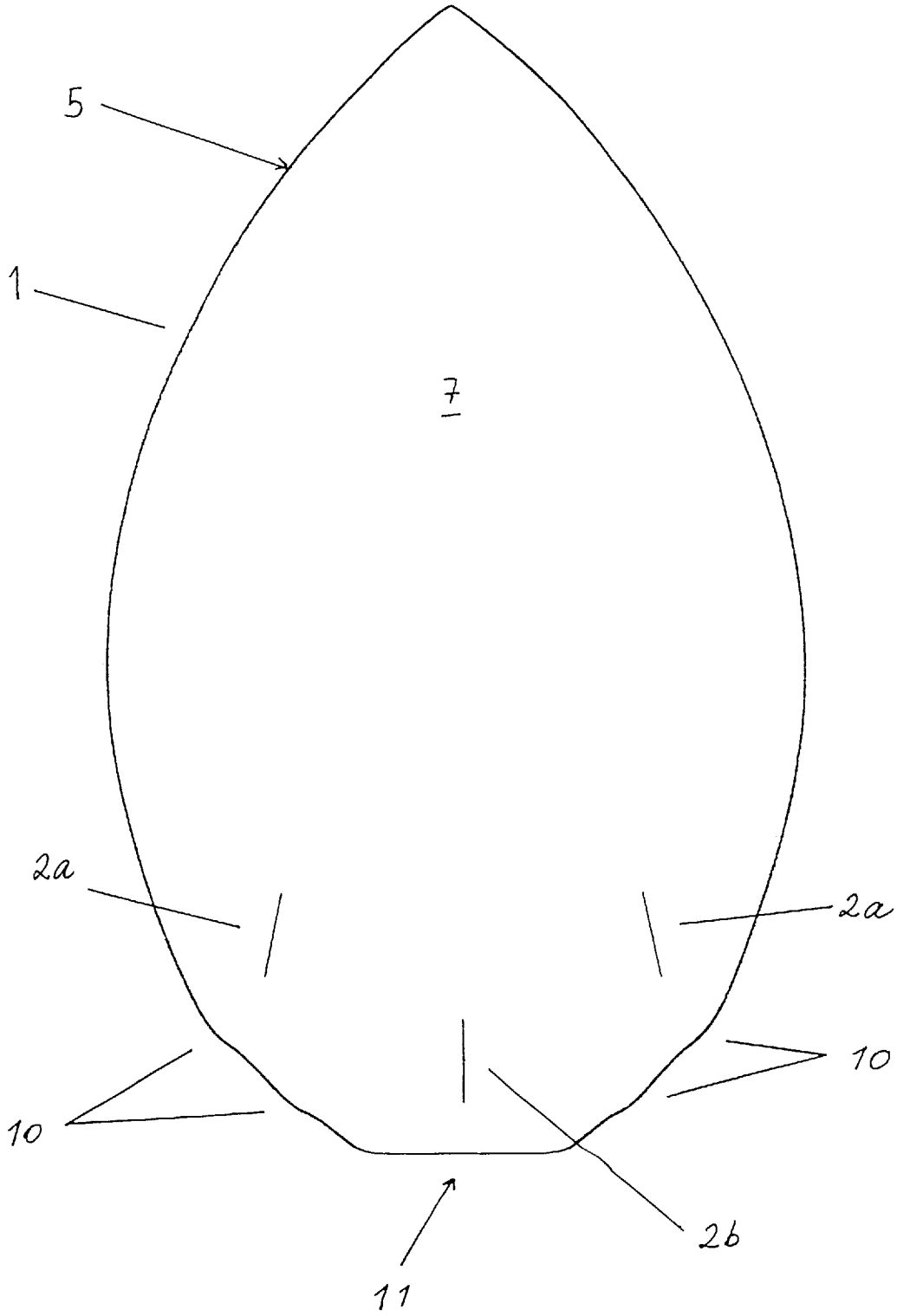
FIG. 6 is a bottom plan view of the present invention, with indication of the position of the directional fins.

Referring to FIG. 5 and FIG. 6 the outer planshape 5 runs rearward from nose to tail along an imaginary central line, determining the total length and maximum width of the FLOATING BODY 1. In its lower part, towards the tail, it has two small accentuated curves 10 that permit to maintain enough widthness in the tail area, then suddenly lowering it in the space of a few centimeters before arriving to the invention's tail 11 itself, which is squared with rounded angles. The fact of maintaining the lower part of the FLOATING BODY 1 as wide as possible helps incrementing the total hydroplaning surface, thus gaining in speed and stability; the squared with rounded angles configuration of the tail 11 permits to keep said tail wide enough without compromising maneuverability.

Referring to FIG. 3 and FIG. 6, the flotation line 6*a*, 6*b*, 6*c* is the lateral profile of the bottom surface (hydroplaning surface) 7 of the invention's FLOATING BODY 1. The flotation line 6*a*, 6*b*, 6*c* determines the invention's effective hydroplaning surface in the longitudinal level; it comprises a continuous line composed of the following three sections: the lifted nose 6*a*, which prevents the invention from frontally sinking in the water; the central straight (no curve) zone 6*b*, which helps incrementing speed and acceleration; and the lifted tail 6*c*, which is much less lifted than the nose and serves to increment maneuverability. The hydroplaning surface 7 is the FLOATING BODY's bottom surface as a whole; it is completely flat (without concave or convex areas, channels or V-shaped zones) in order to produce the greatest possible hydroplaning capability.

Referring to FIG. 3, the overall thickness 8 determines the total volume of the FLOATING BODY 1, hence determining also its buoyancy. It is established empirically by relating the top surface's profile 12 to the floatation line 6*a*, 6*b*, 6*c* along the complete length of the invention; the overall thickness is such that permits an adequate buoyancy, in consideration of the fact that the invention supports the weight of the upper half of the user's body. The point of maximum thickness is located towards the central area of the invention's total length.

Figure 7:
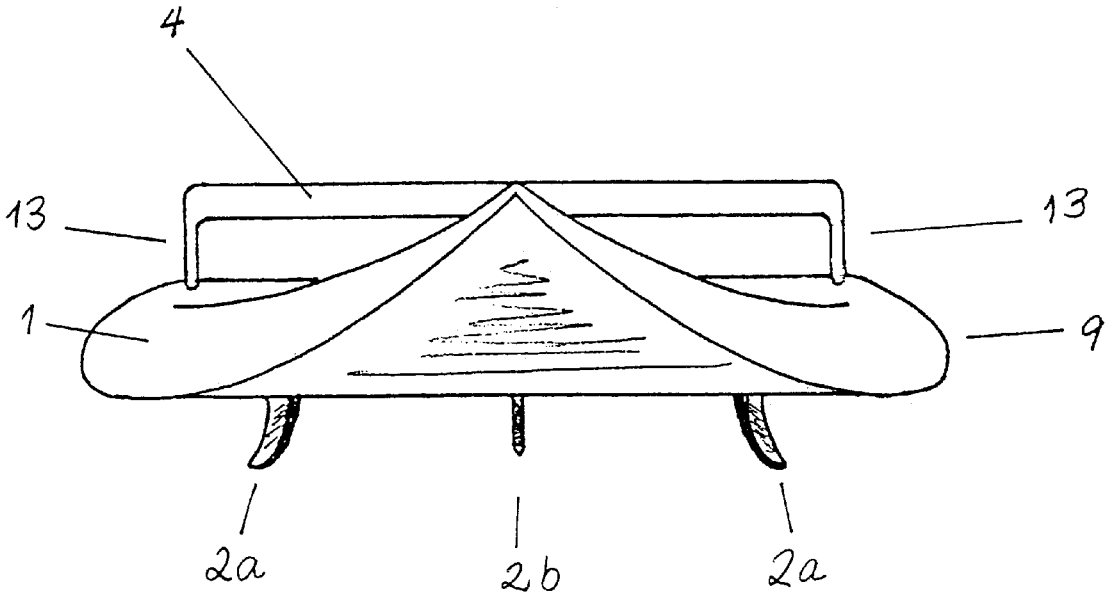
FIG. 7 is a frontal view of the present invention.
Figure 8:
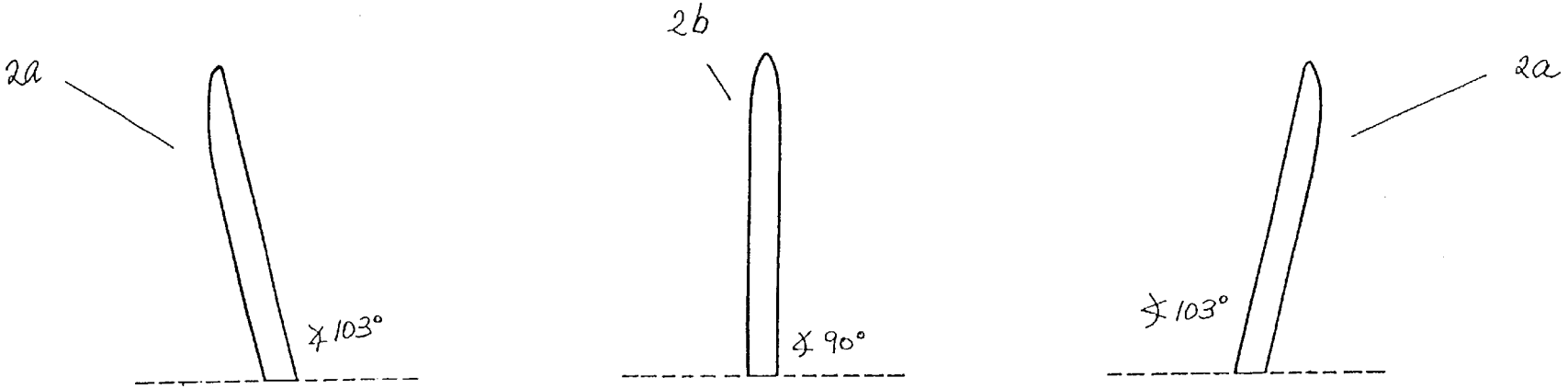
FIG. 8 is a frontal profile view of the directional fins of the present invention.

Referring to FIG. 4 and FIG. 7, the lateral edges' profile 9 is rounded and progressive all along from the nose to the tail of the FLOATING BODY 1, in order to offer the less possible resistance to the water during use. The lateral edges have its lower part more rounded and its upper part more elongated, so as to maximize speed and maneuverability, in consideration of the fact that the lateral edges—in conjunction with the fins and the overall thickness—determine the capability of the invention to keep the chosen trajectories without sliding laterally off the water.

Referring to FIG. 3, FIG. 4, FIG. 6 and FIG. 8, the SYSTEM OF DIRECTIONAL FINS is composed of three small fins fixed in the tail area of the FLOATING BODY's 1 hydroplaning surface 7. The two forward fins 2*a* are placed laterally with an external inclination of 103° with respect to the hydroplaning surface's 7 horizontal plane, being pointed towards the nose of the invention. The third fin 2*b* is the rear fin; it is positioned centrally behind the two lateral forward fins 2*a*, perpendicularly to the hydroplaning surface's 7 horizontal plane, on which the three fins stand. The lateral profile of each directional fin is hydrodynamic, resembling the dorsal fin of a dolphin.

Referring to FIG. 3, FIG. 4 and FIG. 5, the GADGET FOR THE TYING OF A SECURITY CORD 3 is a small piece with a hole in it, positioned in the top surface 12 of the FLOATING BODY 1, in the tail area of the invention—not too close to the tail's edge, because if such were the case it could cause the tail to sink in the water when pulling the security cord or when towing the invention while swimming.

Referring to FIG. 3, FIG. 4, FIG. 5, FIG. 6 and FIG. 7, the HANDLING SYSTEM is composed of a single handle 4 of tubular shape which runs across the width of the invention placed over-raised with respect to the FLOATING BODY's 1 top surface 12, so that it can be grabbed with the two hands placed one beside the other. The handle comprises two symmetrical vertical supports 13 that fix it to the invention's top surface 12; in the longitudinal level this over-raised tubular transversal handle is placed over the point of maximum contact of the hydroplaning surface 7 over the water's horizontal level, approximately in correspondence of the point of maximum width of the invention, towards the center of its total length; the HANDLING SYSTEM's positioning constitutes a critical aspect of the invention's design, because if it were placed too forward the invention would tend to sink the nose in the water; if on the contrary it were placed too rearward the invention would tend to rise the nose, consequently losing speed, stability and steerability.

The afore described embodiment of the invention has been built using the materials and methods normally used in the construction of surfboards (rigid polyurethane foam longitudinally reinforced with an internal piece of wood and laminated with fiberglass cloth and polyester resin). For its industrial construction a different rigid plastic material should be used, probably molded or by the most modern technologies presently available.

Without further analysis, the foregoing will so fully reveal the gist of the present invention that others can readily adapt it or modify it, without departing from the spirit or essential characteristics of this invention. The present embodiments are therefore to be considered in all respects as illustrative and not restrictive, the scope of the invention being indicated by the appended claims rather than by the foregoing description, and all changes that come within the meaning and range of equivalence of the claims are therefore to be intended to be embraced therein.

What I claim as my invention is:

1. A device for the practice of Bodysurfing (surfing the ocean waves with the own body) characterised in that during bodysurfing the device is held and guided with both hands, which are placed together one beside the other in the horizontal level, whereby during wave riding the bodysurfer performs a gymnastical push-up movement over the device, so that the whole upper half of his/her body travels constantly above the water's surface, the device comprising:

a floating body extending along a longitudinal direction from a nose to a tail, having the general shape of a surfboard or windsurf in miniature; and a transversal handling system running across the top surface of said device, in correspondence of the central part of the total length thereof, and having enough width to accommodate the two hands of the user put together one beside the other; and a system of directional tins, placed in the tail area of the bottom surface of said device;

wherein said device has a maximum length of 55 cm, whereby the tail extremity of said device travels approximately in correspondence of the forearms or elbows of the user of said device during bodysurfing.

2. The device of claim 1, wherein said device has progressively rounded lateral edges.

3. The device of claim 1, wherein said transversal handling system comprises a single over-raised handle of a generally tubular shape, fixed to said device by means of two lateral vertical supports.

4. The device of claim 1, wherein said system of directional fins, placed in the tail area of the bottom surface of said device is composed of a group of three fins wherein two lateral fins are placed slightly forward of a central rear fin.

5. The device of claim 1, wherein said device further comprises a gadget intended for the tying of a security cord.

* * * * *